US007382386B2

(12) United States Patent
Matsuzaki et al.

(10) Patent No.: US 7,382,386 B2
(45) Date of Patent: Jun. 3, 2008

(54) IMAGE FORMING APPARATUS

(75) Inventors: Yoshiki Matsuzaki, Ebina (JP); Yoshio Yamaguchi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 371 days.

(21) Appl. No.: 11/246,151

(22) Filed: Oct. 11, 2005

(65) Prior Publication Data

US 2006/0187292 A1 Aug. 24, 2006

(30) Foreign Application Priority Data

Feb. 18, 2005 (JP) ..... 2005-042892

(51) Int. Cl.
*G03G 15/01* (2006.01)

(52) U.S. Cl. ..... 347/116; 399/301

(58) Field of Classification Search ..... 347/116; 399/301, 302

See application file for complete search history.

(56) References Cited

U.S. PATENT DOCUMENTS 5,802,422 A * 9/1998 Hokari ..... 399/36
5,995,717 A * 11/1999 Tanaka ..... 358/1.9
7,050,731 B2 * 5/2006 Bannai et al. ..... 399/49
7,130,551 B2 * 10/2006 Kobayashi ..... 399/49
2005/0214035 A1 * 9/2005 Kamiya ..... 399/301

FOREIGN PATENT DOCUMENTS

| | | |
|---|---|---|
| JP | A-06-263281 | 9/1994 |
| JP | A 09-182488 | 7/1997 |
| JP | A 10-217538 | 8/1998 |
| JP | A 2004-330691 | 11/2004 |

OTHER PUBLICATIONS

Computer-generated translation of JP 06-263281.*

* cited by examiner

*Primary Examiner*—Huan H Tran
(74) *Attorney, Agent, or Firm*—Oliff & Berridge, PLC

(57) ABSTRACT

An image forming apparatus has an image carrier, an exposure array, a reading sensor and a detecting unit. The image carrier carries a toner image. The exposure array forms a latent image. The reading sensor reads a pattern. The reading sensor is provided integrally with the exposure array. The detecting unit detects fluctuation based on the pattern read by the reading sensor.

24 Claims, 19 Drawing Sheets

IMAGE FORMING APPARATUS

CROSS-REFERENCE TO RELATED APPLICATION

This application claims priority under 35 USC 119 from Japanese Patent Application No. 2005-42892, the disclosure of which is incorporated by reference herein.

BACKGROUND

1. Technical Field

The present invention relates to an image forming apparatus equipped with plural image output devices.

2. Related Art

The following method has conventionally been proposed in a registration control system in an image forming apparatus which is equipped with plural image output devices. Patterns for determining a position of an image are determined in advance by respective ROSs (Raster Output Scanners) and then sampled by a CCD. A difference between the positional relationship of the patterns which has no color offset and the sampled data is detected. By using the the detected difference, the writing timings of the ROSs, or the optical positions, are corrected. This method thereby provides good image quality in which there is little registration offset.

SUMMARY

The present invention provides an image forming apparatus which can accurately detect fluctuations in the speed of a drum surface at an exposure position.

The image forming apparatus has an image carrier, an exposure array, a reading sensor and a detecting unit. The image carrier carries a toner image. The exposure array forms a latent image. The reading sensor reads a pattern. The reading sensor is provided integrally with the exposure array. The detecting unit detects fluctuation based on the pattern read by the reading sensor.

BRIEF DESCRIPTION OF THE DRAWINGS

Embodiments of the present invention will be described in detail based on the following figures, wherein.

DETAILED DESCRIPTION

Figure 1:
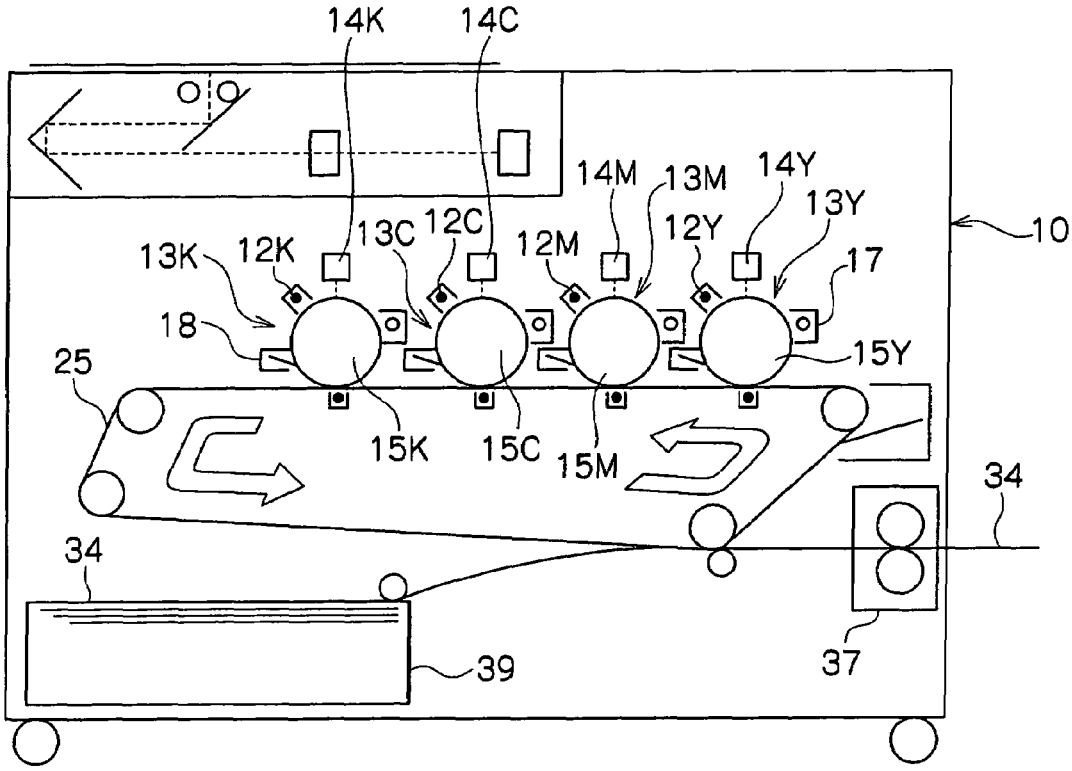
FIG. 1 is a schematic diagram showing an image forming apparatus relating to embodiments of the present invention.

A color image forming apparatus according to a first embodiment of the present invention is shown in FIG. 1.

FIG. 1 is a schematic structural diagram showing a tandem-type digital color printer 10 serving as the color image forming apparatus.

Image forming units 13Y, 13M, 13C, 13K of the respective colors of yellow (Y), magenta (M), cyan (C), and black (K), which serve as image forming units, are lined-up at uniform intervals along the horizontal direction at the interior of the digital color printer 10. When there is no need to differentiate between Y, M, C, K, the letters Y, M, C, K will be omitted.

An intermediate transfer belt 25 is disposed, beneath the four image forming units 13Y, 13M, 13C, 13K. The toner images of the respective colors, which are formed successively by these image forming units, are transferred onto the intermediate transfer belt 25 in a state of being superposed one on another.

Then, the toner images of the respective colors, which are transferred in a superposed manner on the intermediate transfer belt 25, are transferred all at once onto a recording sheet 34 which serves as a recording medium and which is fed-out from a sheet feed tray 39 or the like. Thereafter, the superposed toner images are fixed onto the recording sheet 34 by a fixing device 37, and the recording sheet 34 is discharged to the exterior.

The image forming units 13Y, 13M, 13C, 13K are basically structured by photosensitive drums 15Y, 15M, 15C, 15K which serve as image carriers and which rotate at predetermined rotational speeds along the directions of the arrows; scorotrons 12Y, 12M, 12C, 12K for primary charging which uniformly charge the surfaces of the photosensitive drums 15Y, 15M, 15C, 15K; exposure arrays 14Y, 14M, 14C, 14K which expose images corresponding to the respective colors on the surfaces of the photosensitive drums 15Y, 15M, 15C, 15K so as to form electrostatic latent images; developing devices 17 which develop the electrostatic latent images formed on the photosensitive drums 15Y, 15M, 15C, 15K; and cleaning devices 18.

Next, main portions of the image forming apparatus relating to the first embodiment of the present invention will be described.

Figure 2:
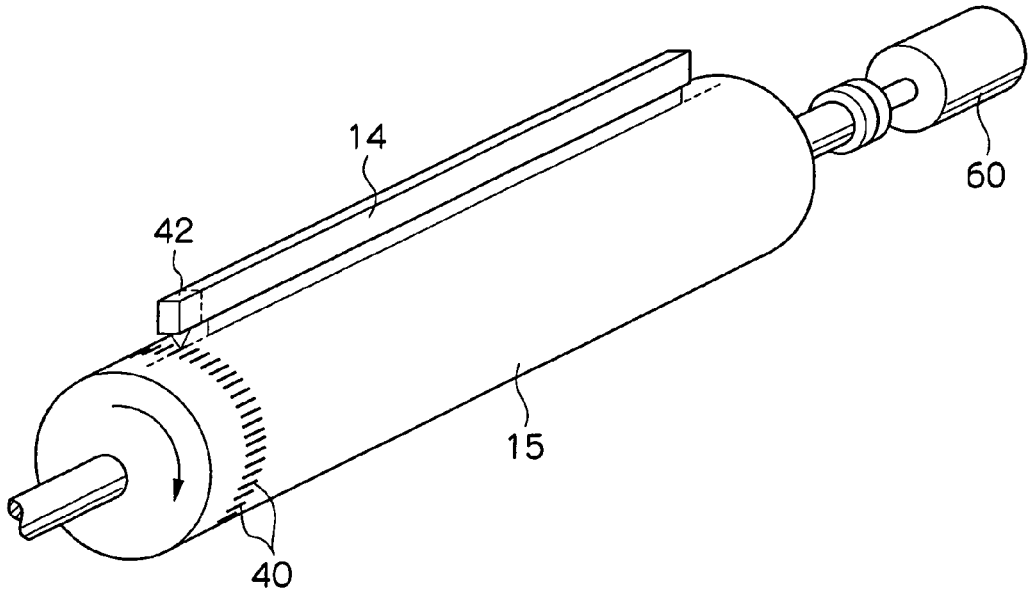
FIG. 2 is a perspective view showing an exposure array and a circumferential direction reading sensor of an image forming apparatus relating to a first embodiment of the present invention.
Figure 3:
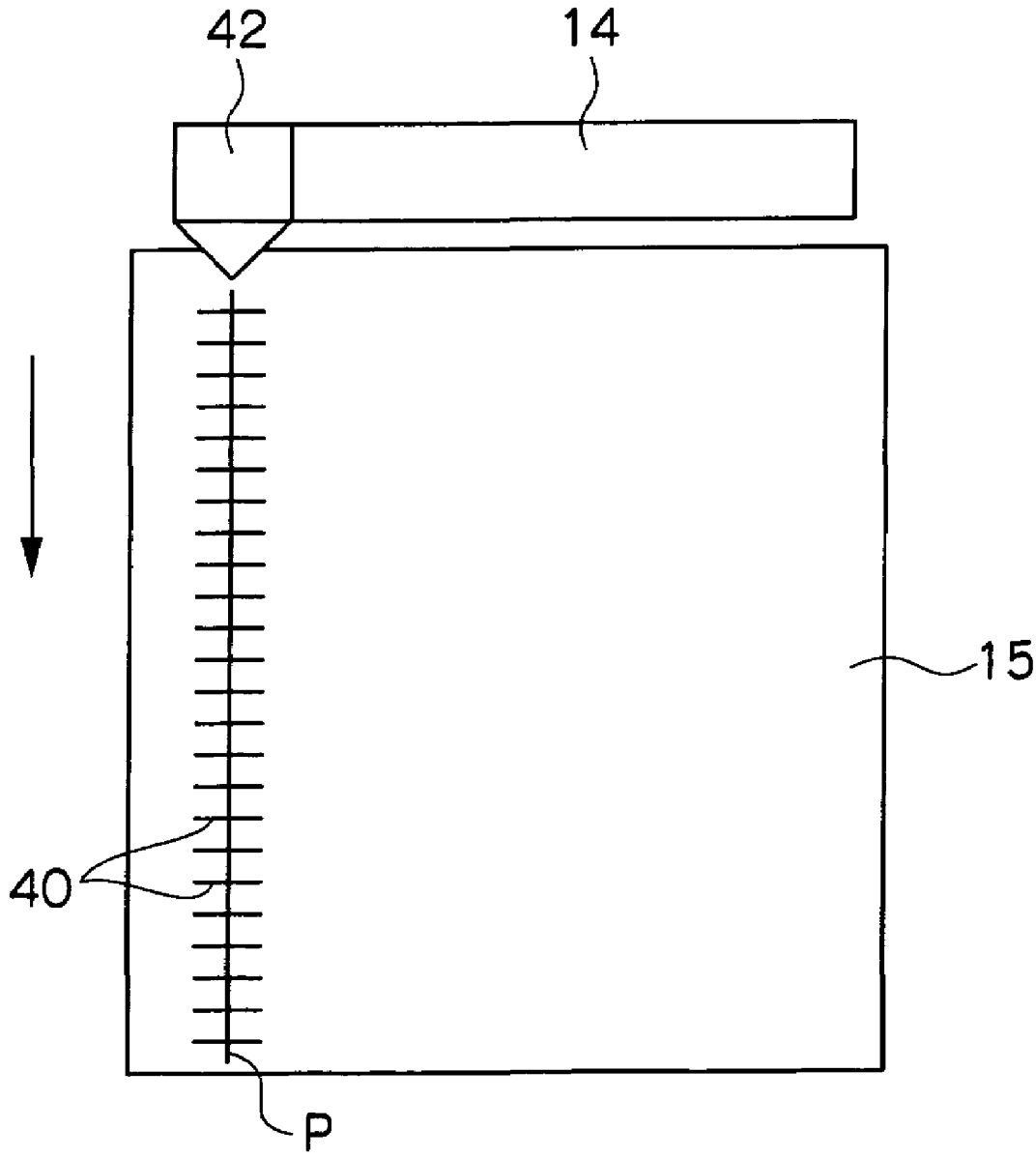
FIG. 3 is a diagram in which the exposure array, the circumferential direction reading sensor, and a surface of a photosensitive drum of the image forming apparatus relating to the first embodiment of the present invention are expanded along a circumferential direction.

As shown in FIGS. 2 and 3, lines, which are parallel to the axial direction of the photosensitive drum 15, are formed at one end side of the photosensitive drum 15 at predetermined intervals along the circumferential direction of the photosensitive drum 15. (Hereinafter, these lines are called a "circumferential direction formed pattern 40").

A circumferential direction reading sensor 42 is provided integrally with the one end portion of the exposure array 14 positioned above the photosensitive drum 15. The circumferential direction reading sensor 42 is disposed at a position facing the circumferential direction formed pattern 40 which is formed on the one end portion of the photosensitive drum 15.

Figure 4:
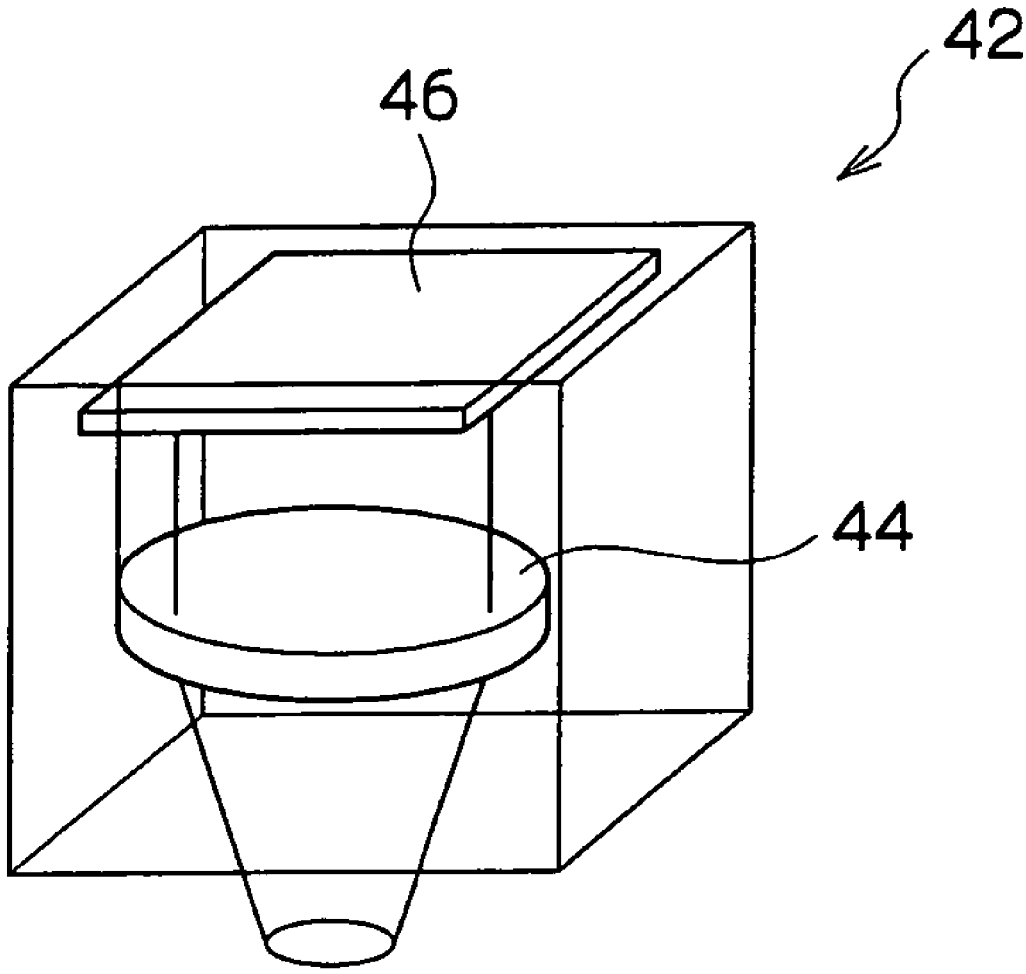
FIG. 4 is a schematic diagram showing the structure of the circumferential direction reading sensor of the image forming apparatus relating to the first embodiment of the present invention.

As shown in FIG. 4, the circumferential direction reading sensor 42 has a lens 44 which collects light, and a light-receiving portion 46 which receives reflected light. The circumferential direction reading sensor 42 collects light, which is emitted by an LED (not shown) on the surface of the photosensitive drum 15 by the lens 44 (at a so-called detecting position, a central line P (see FIG. 3) of the circumferential direction formed pattern 40), and the light which reaches the surface of the photosensitive drum 15 and is reflected thereat is incident on the light-receiving portion 46.

The photosensitive drum 15 is formed of aluminum. Therefore, the reflectance of light toward the light-receiving portion 46 is high at the portions where the circumferential direction formed pattern 40 is not formed, and the reflectance of light reflected to the light-receiving portion 46 is low at the circumferential direction formed pattern 40. The presence/absence of the circumferential direction formed pattern 40 can be confirmed by the difference of the reflectance of the light toward the light-receiving portion 46.

Figure 5:
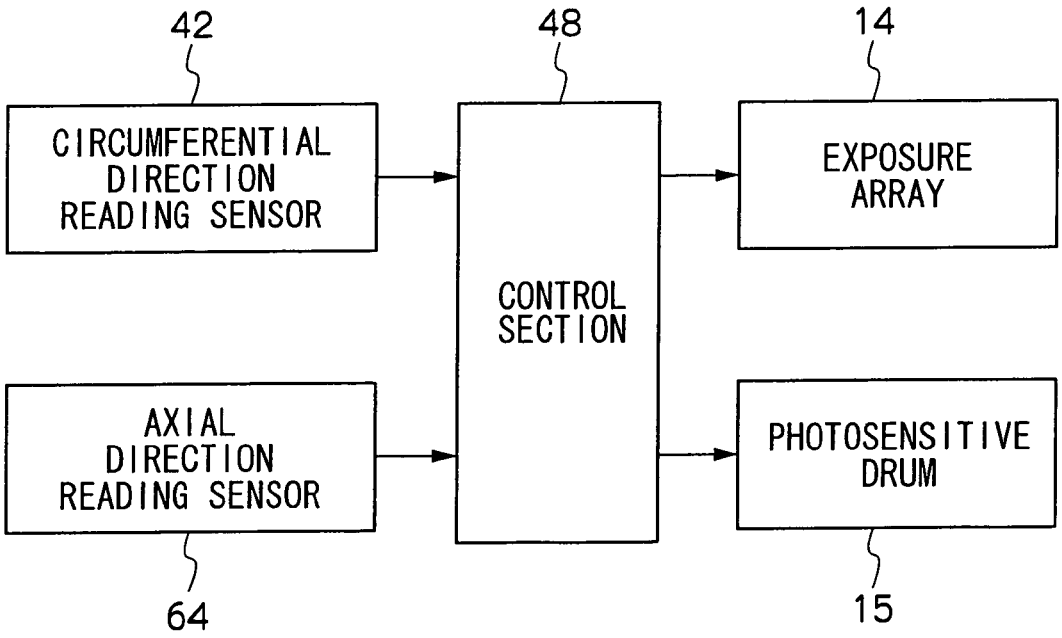
FIG. 5 is a block diagram showing the relationships between a control section, the exposure array and the circumferential direction reading sensor of the image forming apparatus relating to the first embodiment of the present invention.

Here, as shown in FIG. 5, the circumferential direction reading sensor 42 is connected to a control section 48. Information read by the difference in the reflectance of the light reflected toward the light-reflecting portion 46 (i.e., data expressing the presence/absence of the circumferential direction formed pattern 40) is inputted to the control section 48 (step 100 of FIG. 6).

As shown in FIG. 3 (FIG. 3 is a diagram in which the surface of the photosensitive drum 15 is expanded along the circumferential direction), the circumferential direction formed pattern 40 is formed at predetermined intervals along the circumferential direction of the photosensitive drum 15. Therefore, as the photosensitive drum 15 rotates, the presence/absence of the circumferential direction formed pattern 40 is detected alternately. Because the photosensitive drum 15 is rotating at a given rotational speed, the circumferential direction formed pattern 40 is detected at the same interval. The surface speed of the photosensitive drum 15 is detected by the interval of the detected circumferential direction formed pattern 40 (step 102 of FIG. 6).

By providing the circumferential direction reading sensor 42 integrally with the exposure array 14 as shown in FIG. 2, the exposure array 14 and the circumferential direction reading sensor 42 can be positioned as a fixed positional relationship.

Therefore, the positional relationship between the exposure array 14 and the circumferential direction reading sensor 42 does not change due to, for example, fluctuations in the position of the exposure array 14 due to errors in the mounting of the exposure array 14 or fluctuations in the temperature within the digital color printer 10 (see FIG. 1), or the like.

Accordingly, the surface speed of the photosensitive drum 15 can be detected accurately along the circumferential direction of the photosensitive drum 15. The accuracy of detection is improved, and accordingly, the accuracy of correcting periodic fluctuations (so-called AC fluctuations) in the subscanning direction is improved.

Further, with regard to the distance between the exposure array 14 and the photosensitive drum 15, highly-accurate mounting is required from the standpoint of limits on the focal depth (±0.1 mm). Therefore, by providing the exposure array 14 and the circumferential direction reading sensor 42 integrally, the mounting accuracy of the circumferential direction reading sensor 42 with respect to the photosensitive drum 15 also improves. Thus, the adjusting of the focal depth of the circumferential direction reading sensor, which has an enlarging/reducing optical system (the lens 44 (see FIG. 4)), can be carried out with high accuracy, and the accuracy of detection can be improved.

Figure 7A:
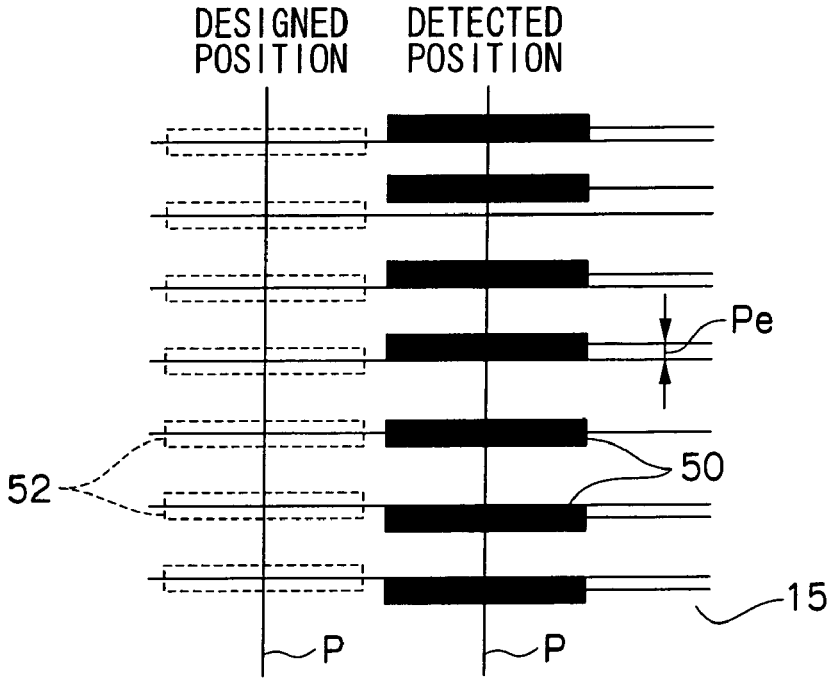
FIG. 7A is a diagram for explaining fluctuations in angular velocity of the photosensitive drum, in which the surface of the photosensitive drum of the image forming apparatus relating to the first embodiment of the present invention is expanded along the circumferential direction.

FIG. 7A is a diagram in which the surface of the photosensitive drum 15 is expanded along the circumferential direction. A circumferential direction formed pattern 50, which is read at the circumferential direction reading sensor 42, is supposed to be the same interval as a circumferential direction formed pattern 52 (the dotted lines) which is shown at the originally designed position. However, when the surface speed of the photosensitive drum 15 fluctuates due to an eccentricity or the like, an offset Pe (see FIG. 7A) arises with respect to the circumferential direction formed pattern 52 at the designed position.

Figure 6:
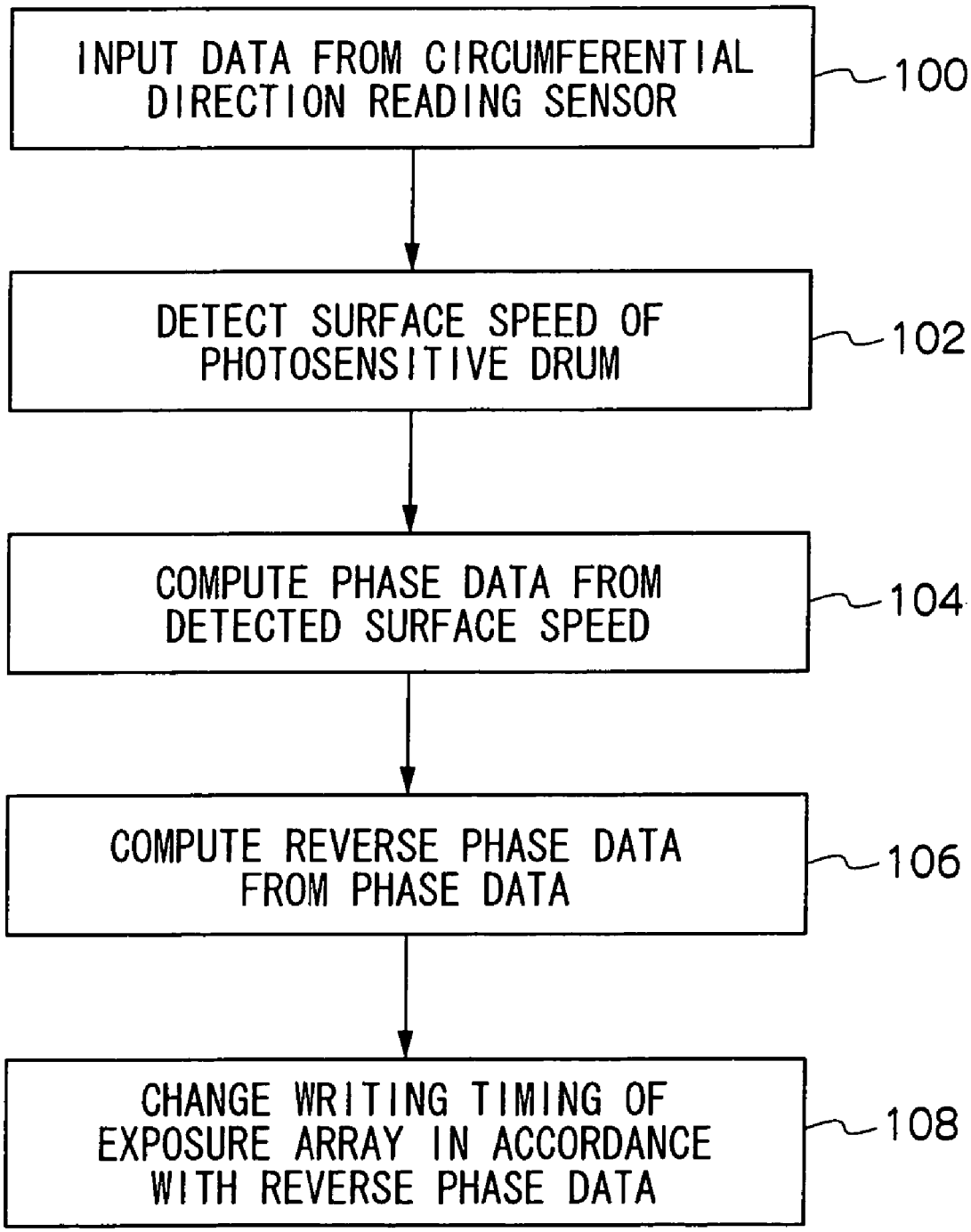
FIG. 6 is a flowchart showing operation of the image forming apparatus relating to the first embodiment of the present invention.
Figure 7B:
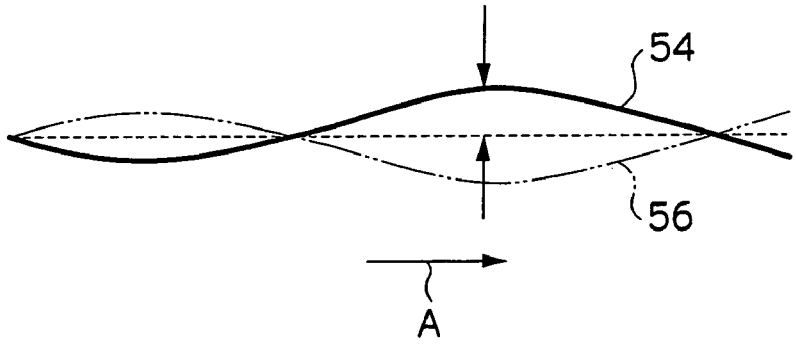
FIG. 7B is a diagram for explanation of correcting the fluctuations in the angular velocity of the photosensitive drum.

As shown in FIG. 7B, the control section 48 computes the fluctuations in the surface speed of the photosensitive drum 15, or the positional fluctuations in the circumferential direction caused thereby, as phase data 54 along the circumferential direction of the photosensitive drum 15 (the direction of arrow A) (step 104 of FIG. 6). Further, the control section 48 computes reverse phase data 56 which offsets this phase data 54 (step 106 of FIG. 6).

As shown in FIG. 5, the control section 48 is connected to the exposure array 14. As a first correcting unit, the control section 48 changes the writing timing of the exposure array 14 (step 108 of FIG. 6), on the basis of the reverse phase data 56 which is computed by the control section 48 and which is with respect to fluctuations in the angular velocity computed from the surface speed fluctuations of the photosensitive drum 15. In this way, the fluctuations in the angular velocity of the photosensitive drum 15 are offset, and the fluctuations can be made to be small.

Figure 8:
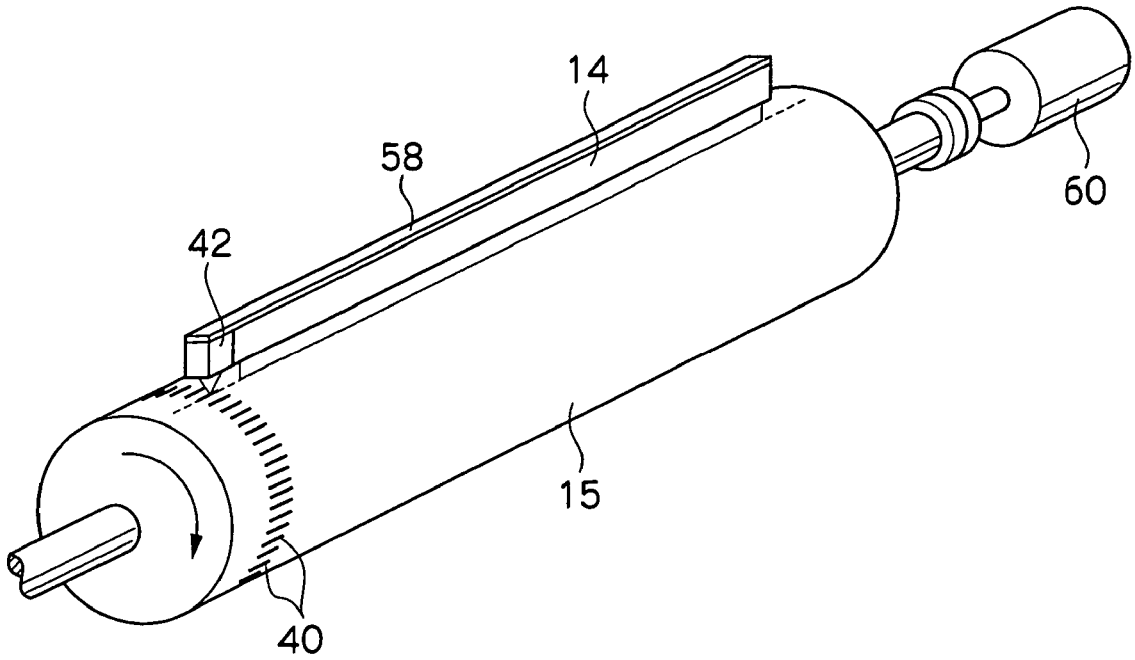
FIG. 8 is a perspective view showing a modified example of the exposure array and the circumferential direction reading sensor of the image forming apparatus relating to the first embodiment of the present invention.

Although the circumferential direction reading sensor 42 is provided integrally with the one end portion of the exposure array 14 here, it suffices to position the exposure array 14 and the circumferential direction reading sensor 42 as a fixed positional relationship. Therefore, the present invention is not limited to the above-described structure. For example, as shown in FIG. 8, the exposure array 14 and the circumferential direction reading sensor 42 may be fixed to a flat-plate-shaped supporting member 58.

In the present embodiment, the writing timing of the exposure array 14 is changed on the basis of the reverse phase data 56 with respect to the fluctuations in the angular velocity of the photosensitive drum 15. However, because it suffices to make the fluctuations in the angular velocity of the photosensitive drum 15 small, the present invention is not limited to the same. For example, as a second correcting unit, the rotational speed of a motor 60 which is connected to the photosensitive drum 15 can be varied on the basis of the reverse phase data 56 with respect to the fluctuations in the angular velocity of the photosensitive drum 15, and the fluctuations in the angular velocity of the photosensitive drum 15 can be made to be small.

Next, main portions of an image forming apparatus relating to a second embodiment of the present invention will be described. Some parts are substantially the same as those of the first embodiment of the present invention will be omitted.

Figure 9:
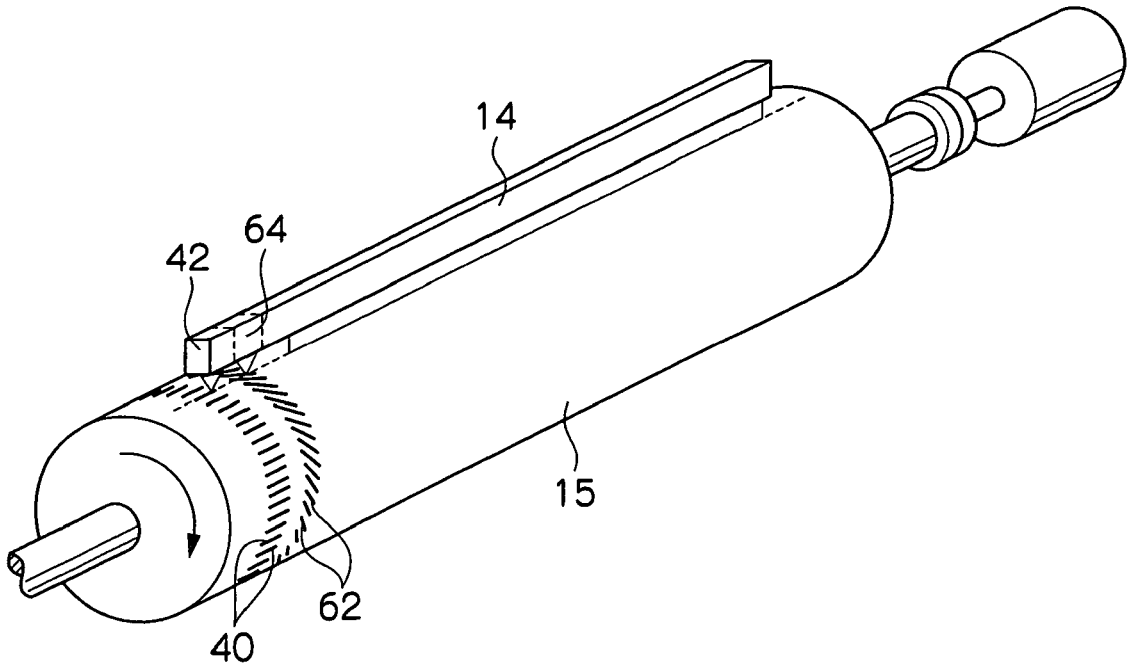
FIG. 9 is a perspective view showing an exposure array and a circumferential direction reading sensor of an image forming apparatus relating to a second embodiment of the present invention.
Figure 10:
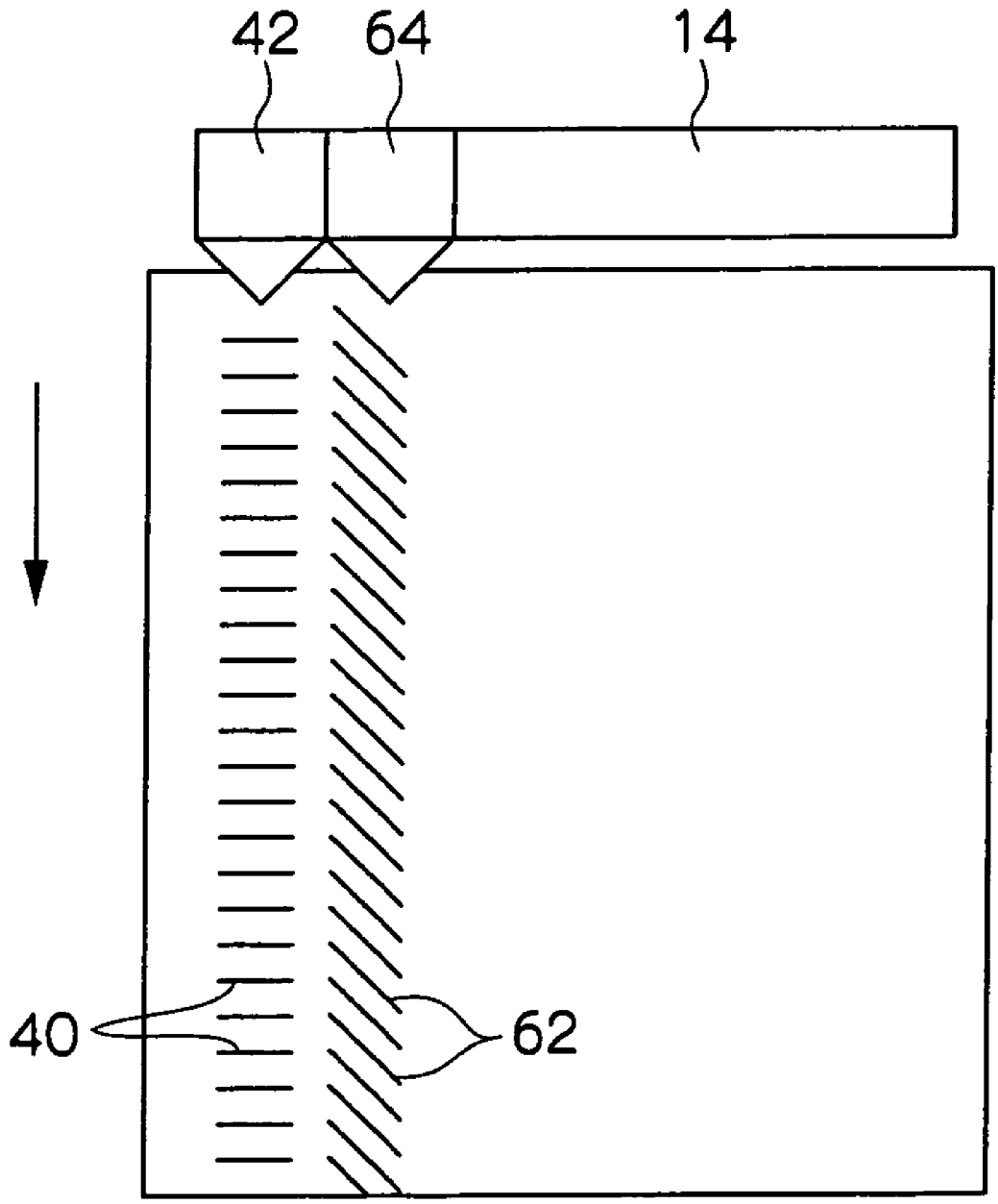
FIG. 10 is a diagram in which the exposure array, the circumferential direction reading sensor, and a surface of a photosensitive drum of the image forming apparatus relating to the second embodiment of the present invention are expanded along a circumferential direction.

As shown in FIGS. 9 and 10 (FIG. 10 is a diagram in which the surface of the photosensitive drum 15 is expanded along the circumferential direction), in addition to the circumferential direction formed pattern 40, an axial direction formed pattern 62, which is inclined with respect to the axial direction of the photosensitive drum 15, is formed at one end side of the photosensitive drum 15 at the inner side of the circumferential direction formed pattern 40. The axial direction formed pattern 62 is disposed at predetermined intervals along the circumferential direction of the photosensitive drum 15.

On the other hand, the circumferential direction reading sensor 42 and an axial direction reading sensor 64 are provided integrally at one end portion of the exposure array 14. The circumferential direction reading sensor 42 and the axial direction reading sensor 64 are disposed so as to face the circumferential direction formed pattern 40 and the axial direction formed pattern 62, respectively, and can detect fluctuations in the angular velocity of the photosensitive drum (rotational direction offset) as well as axial direction offset of the photosensitive drum 15. Here, the structure of the axial direction reading sensor 64 is the same as that of the circumferential direction reading sensor 42, so the description thereof will be omitted.

Figure 11:
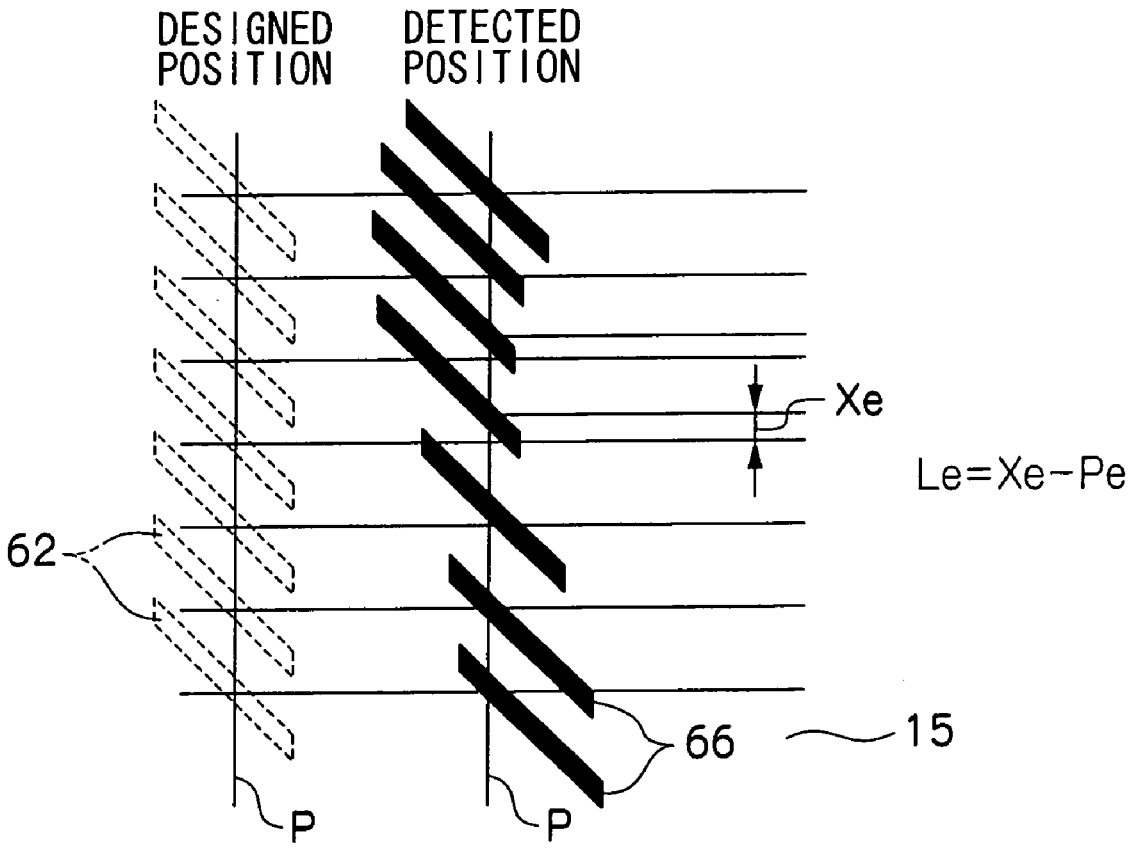
FIG. 11 is a diagram for explaining axial direction offset of the photosensitive drum, where the surface of the photosensitive drum of the image forming apparatus relating to the second embodiment of the present invention is expanded along the circumferential direction.

FIG. 11 is a diagram in which the surface of the photosensitive drum 15 is expanded along the circumferential direction. An axial direction formed pattern 66, which is read at the axial direction reading sensor 64, is originally supposed to be the same interval as the axial direction formed pattern 62 (the dotted lines) which is shown at the designed position. However, when the axial direction position of the photosensitive drum 15 differs in the circumferential direction of the photosensitive drum 15 due to mounting errors or the like, an offset Xe (see FIG. 11) arises with respect to the axial direction formed pattern 62 which is at the designed position.

Since this offset (Xe) includes the offset (Pe) which is due to the fluctuations in the angular velocity of the photosensitive drum 15, an offset amount (Le) of the axial direction formed pattern 66 is a value obtained by subtracting the offset (refer to Pe (FIG. 7A)) in the circumferential direction of the photosensitive drum 15 due to the angular velocity fluctuations, from the offset (Xe) with respect to the axial direction formed pattern 62 at the designed position. The axial direction offset of the photosensitive drum 15 can be computed on the basis of this offset amount (Le).

Here, by providing the circumferential direction reading sensor 42 and the axial direction reading sensor 64 integrally with the exposure array 14 as shown in FIGS. 9 and 10, the exposure array 14, and the circumferential direction reading sensor 42 and the axial direction reading sensor 64 can be positioned as a fixed positional relationship.

Therefore, the positional relationship between the exposure array 14, and the circumferential direction reading sensor 42 and the axial direction reading sensor 64 does not change due to fluctuations in the position of the exposure array 14 or the like. Accordingly, the angular velocity and the axial direction position of the photosensitive drum 15 can be calculated accurately along the circumferential direction of the photosensitive drum 15. The accuracy of detection is improved, and accordingly, the accuracy of correcting periodic fluctuations (so-called AC fluctuations) in the main scanning direction and the subscanning direction is improved.

Namely, the control section 48 computes the angular velocity and the axial direction offset of the photosensitive drum 15 respectively as phase data 54 along the circumferential direction of the photosensitive drum 15, and computes reverse phase data 56 which offsets this phase data 54.

Figure 12A:
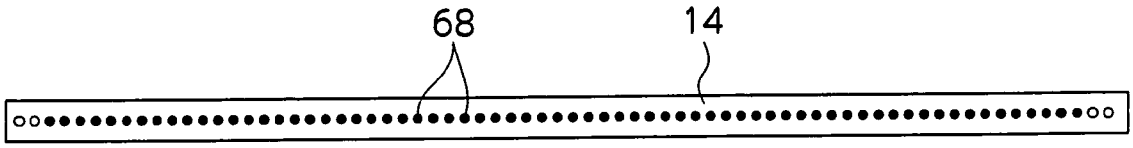
FIGS. 12A, 12B and 12C are diagrams for explaining correcting of axial direction offset of the photosensitive drum.
Figure 12B:
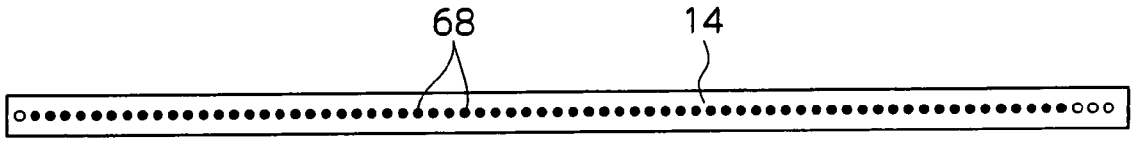
Figure 12C:
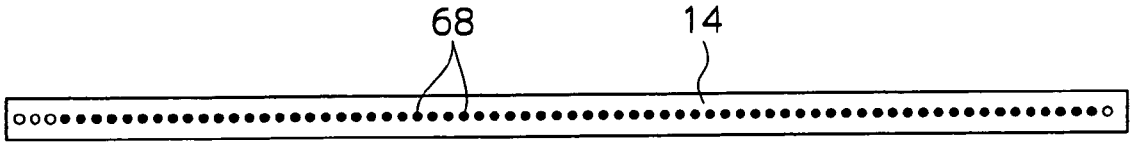

Then, on the basis of the reverse phase data 56 which is computed by the control section 48 and which is with respect to fluctuations in the angular velocity of the photosensitive drum 15, the control section 48 changes the writing timing of the exposure array 14. Further, on the basis of the reverse phase data which is computed by the control section 48 and which is with respect to the axial direction offset of the photosensitive drum 15, as shown in FIGS. 12A through 12C, the control section 48 changes the range of the LEDs 68 which are used, and changes the write positions (shown by the black circles) of the exposure array 14 as a third correcting unit.

In this way, the fluctuations in the angular velocity of the photosensitive drum 15 are offset, and these fluctuations are made to be small. Further, the axial direction offset of the photosensitive drum 15 is offset, and this offset can be made to be small.

Note that the embodiments are strictly examples, and it goes without saying that appropriate modifications can be made within a scope which does not deviate from the gist of the present invention.

In the present embodiment, the write positions of the exposure array 14 are changed on the basis of the reverse phase data with respect to the axial direction offset of the photosensitive drum 15. However, it suffices to be able to make the axial direction offset of the photosensitive drum 15 small, so the present invention is not limited to the embodiments as mentioned above.

Figure 13:
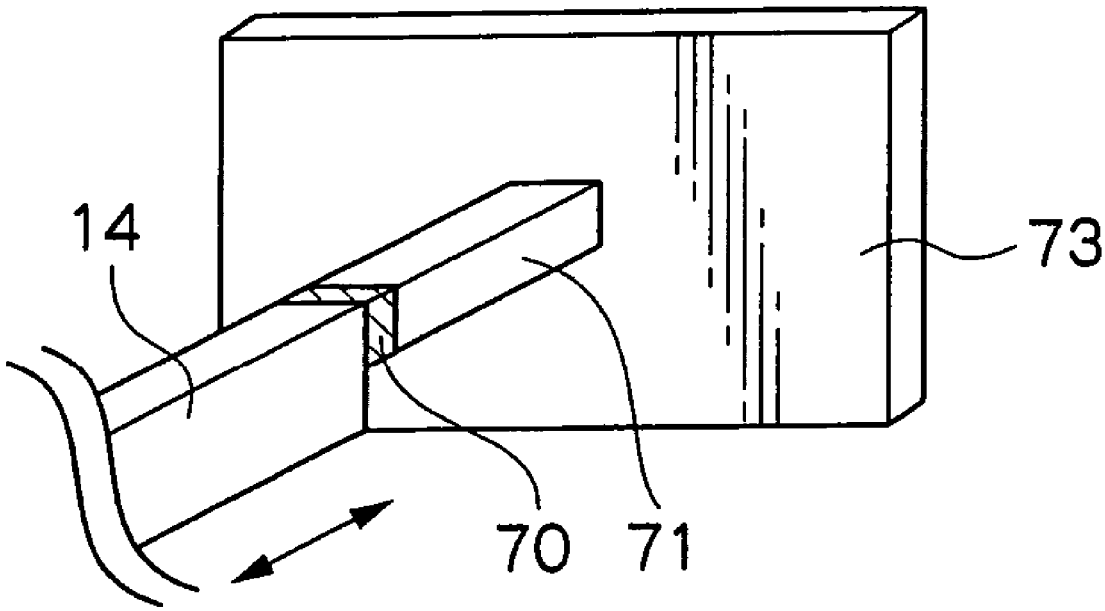
FIG. 13 is a perspective view showing a first modified example of correcting axial direction offset of the photosensitive drum.

For example, the exposure array 14 itself may be made to be movable along the axial direction of the photosensitive drum 15. Concretely, as shown in FIG. 13, the following structure may be employed: a piezoelectric element 70 connected to the control section 48 is disposed at the other end portion of the exposure array 14. An end portion of a piezoelectric holding member 71, which holds the piezoelectric element 70, is fixed to a fixing member 73. Thus, when voltage is applied to the piezoelectric element 70, the piezoelectric element 70 flexurally deforms toward the exposure array 14. The exposure array 14 is moved along the axial direction of the photosensitive drum 15 in accordance with the amount of flexural deformation of the piezoelectric element 70.

Figure 14A:
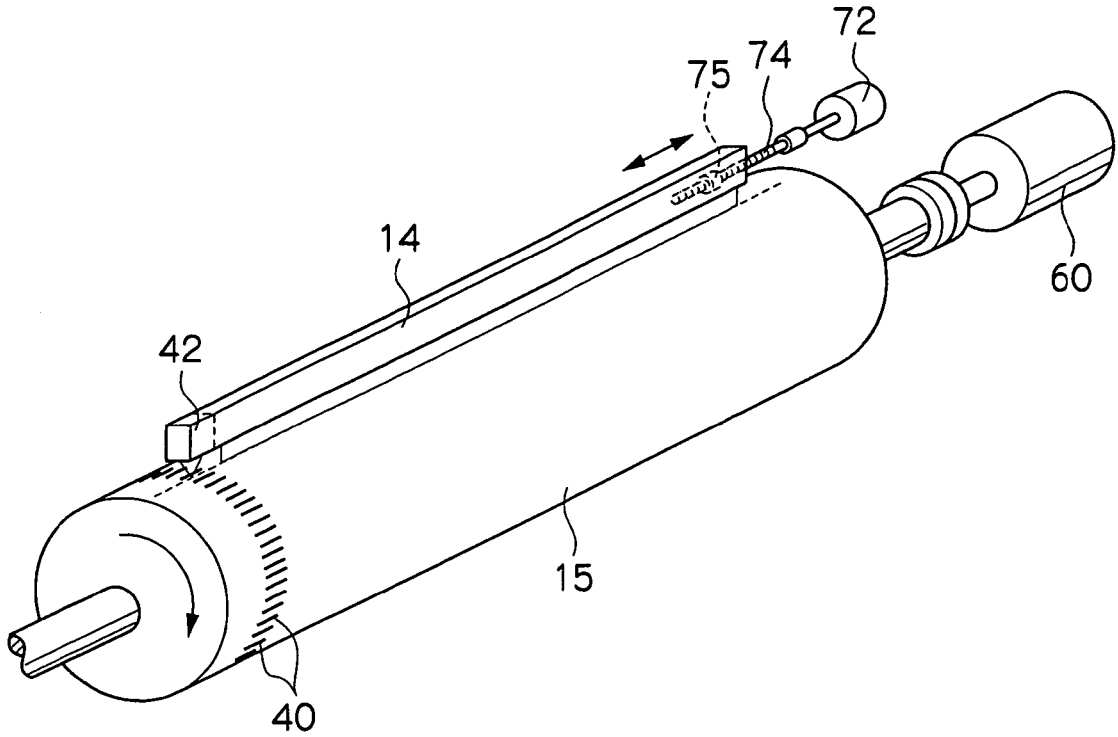
FIGS. 14A and 14B are perspective views showing a second modified example of correcting axial direction offset of the photosensitive drum.
Figure 14B:
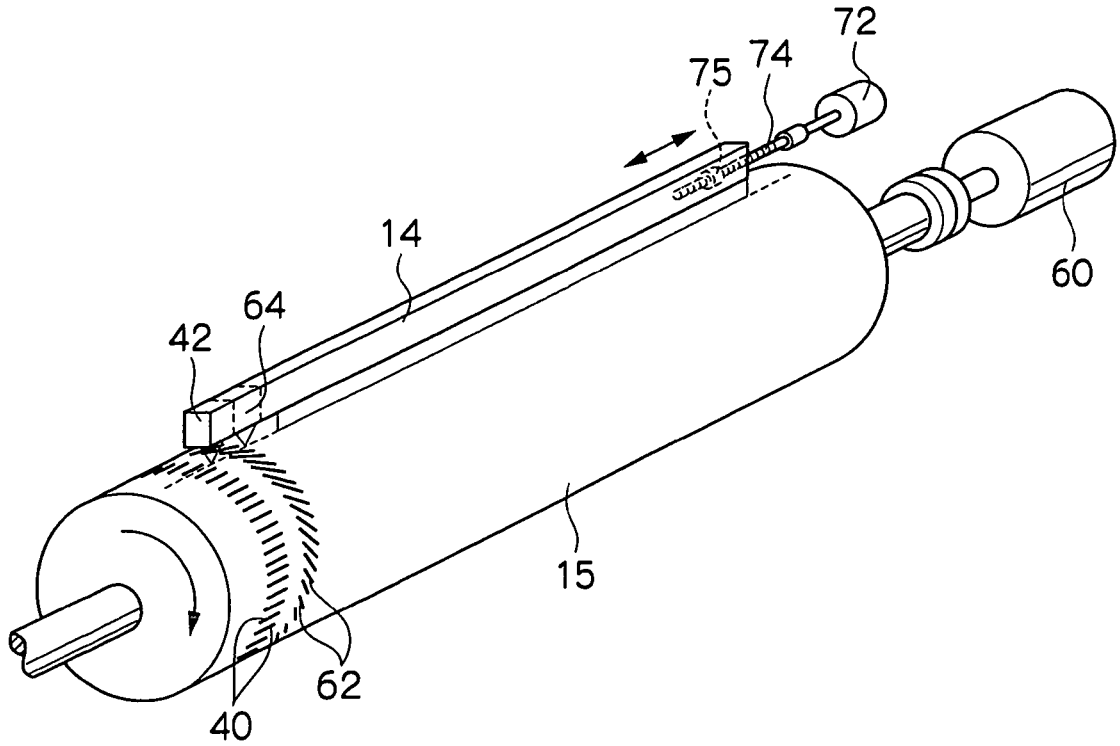

Further, as shown in FIGS. 14A and 14B, the following structure may be employed: a ball screw 74, which is connected to a motor 72 which is connected to the control section 48, is screwed-into an exposure array 14 side nut 75 at the other end portion of the exposure array 14. Due to the motor 72 rotating, the ball screw 74 is rotated, and the exposure array 14 is moved along the axial direction of the photosensitive drum 15 via the nut 75.

Figure 15:
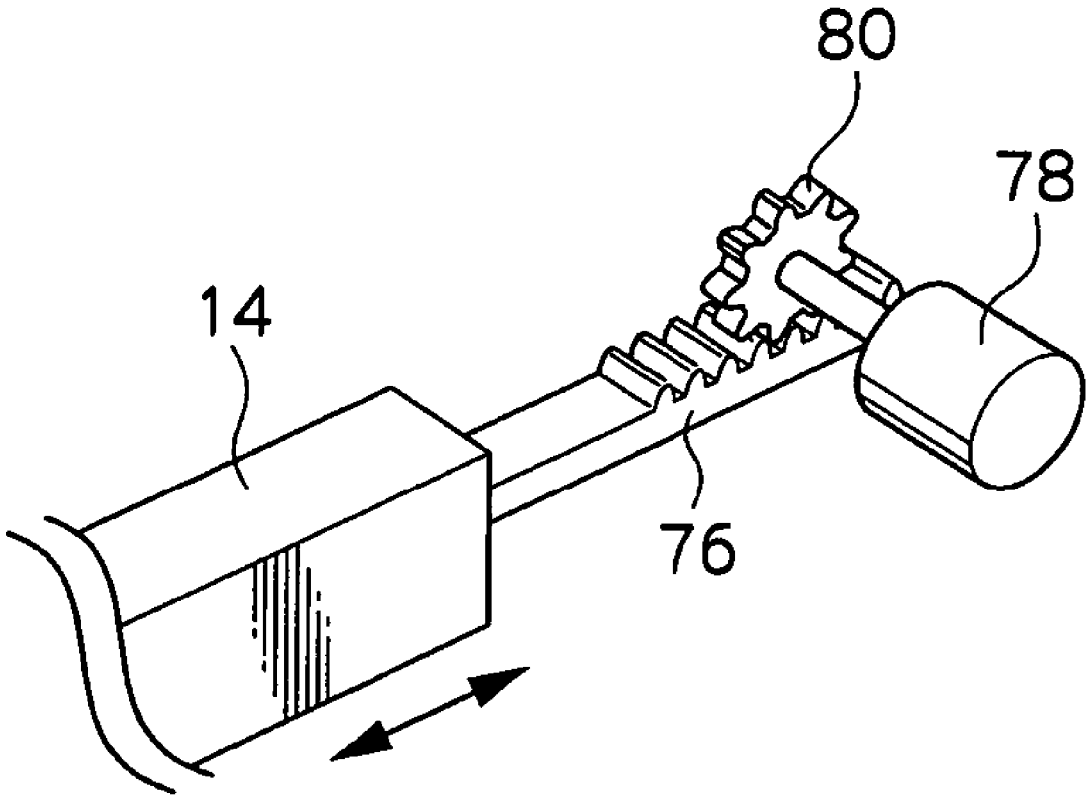
FIG. 15 is perspective view showing a third modified example of correcting axial direction offset of the photosensitive drum.

Still further, as shown in FIG. 15, the following structure may be employed: a rack 76 juts out at the other end portion of the exposure array 14. A pinion 80, which is connected to a motor 78 which is connected to the control section 48, meshes with the rack 76. Due to the motor 78 rotating, the exposure array 14 is moved along the axial direction of the photosensitive drum 15 via the pinion 80 and the rack 76.

Figure 16:
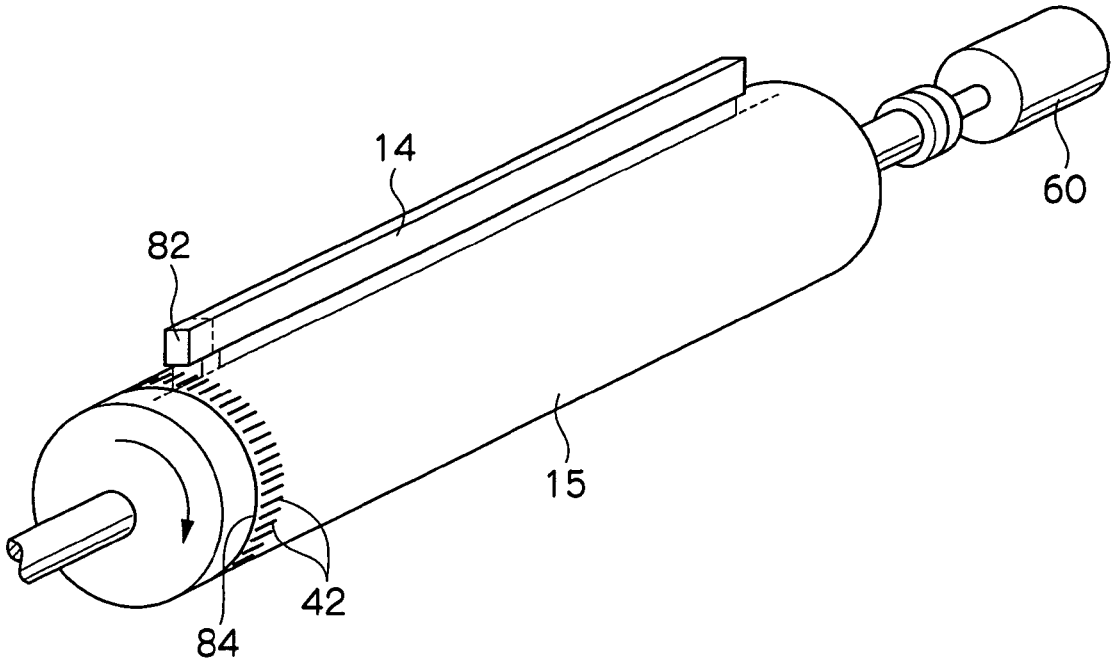
FIG. 16 is a perspective view showing a modified example of the circumferential direction reading sensor.
Figure 17A:
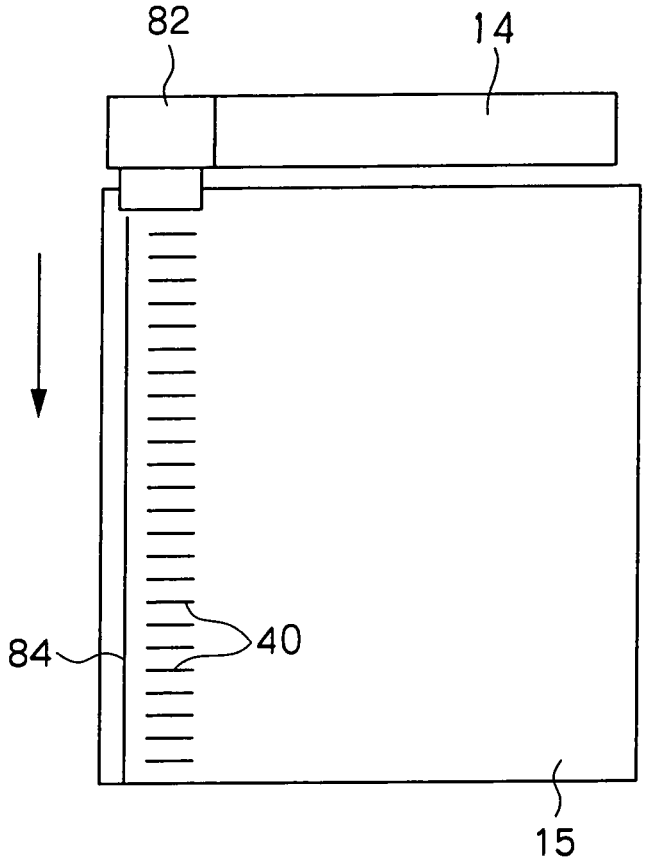
FIG. 17A is a diagram in which the surface of the photosensitive drum shown in FIG. 16 is expanded along the circumferential direction.

In the present embodiment, as shown in FIGS. 2 and 3, light is collected at the central line P of the circumferential direction formed pattern 40 by using the circumferential direction reading sensor 42. However, as shown in FIGS. 16 and 17A (FIG. 17A is a diagram in which the surface of the photosensitive drum 15 is expanded along the circumferential direction), the circumferential direction formed pattern 40 and an axial direction formed pattern 84, which is formed along the circumferential direction at a predetermined position in the axial direction of the photosensitive drum 15 at the outer side of the circumferential direction formed pattern 40, may be read as image data by using a CCD sensor 82.

Figure 17B:
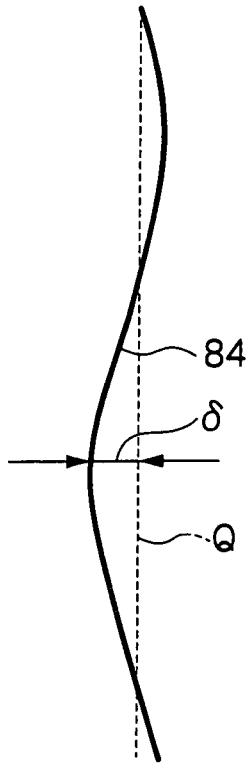
FIG. 17B is a diagram for explaining axial direction offset of the photosensitive drum.

In this case, the following structure can be employed in order to broaden the reading region: even though the axial direction formed pattern 84 is a straight line running along the circumferential direction of the photosensitive drum 15, by determining the amount of offset between the axial direction formed pattern 84 and a reading reference line Q, an offset amount δ (see FIG. 17B) in the axial direction of the photosensitive drum 15 can be detected.

Moreover, in the present embodiment, for example, the angular velocity of the photosensitive drum 15 is computed as the phase data 54 along the circumferential direction of the photosensitive drum 15, the reverse phase data 56 which offsets the phase data 54 is computed, and the fluctuations in the angular velocity of the photosensitive drum 15 are made to be small. However, because it suffices to be able to make the fluctuations in the angular velocity of the photosensitive drum 15 small, the present invention is not limited to this method.

Figure 18:
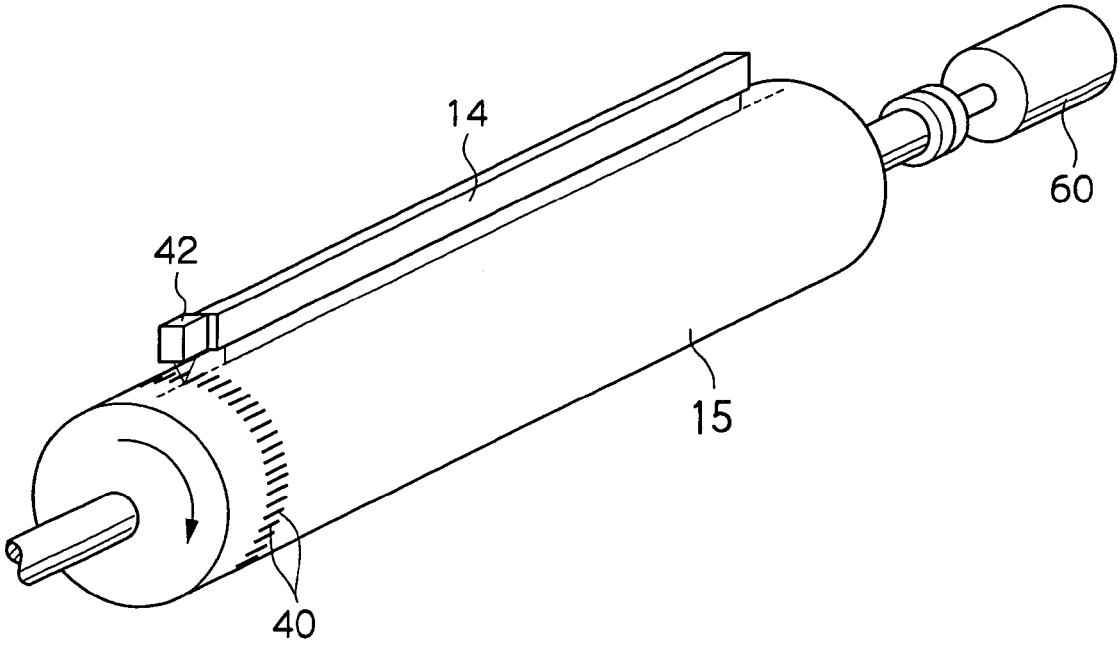
FIG. 18 is a perspective view showing a method of correcting circumferential direction offset of the photosensitive drum in real time.
Figure 19:
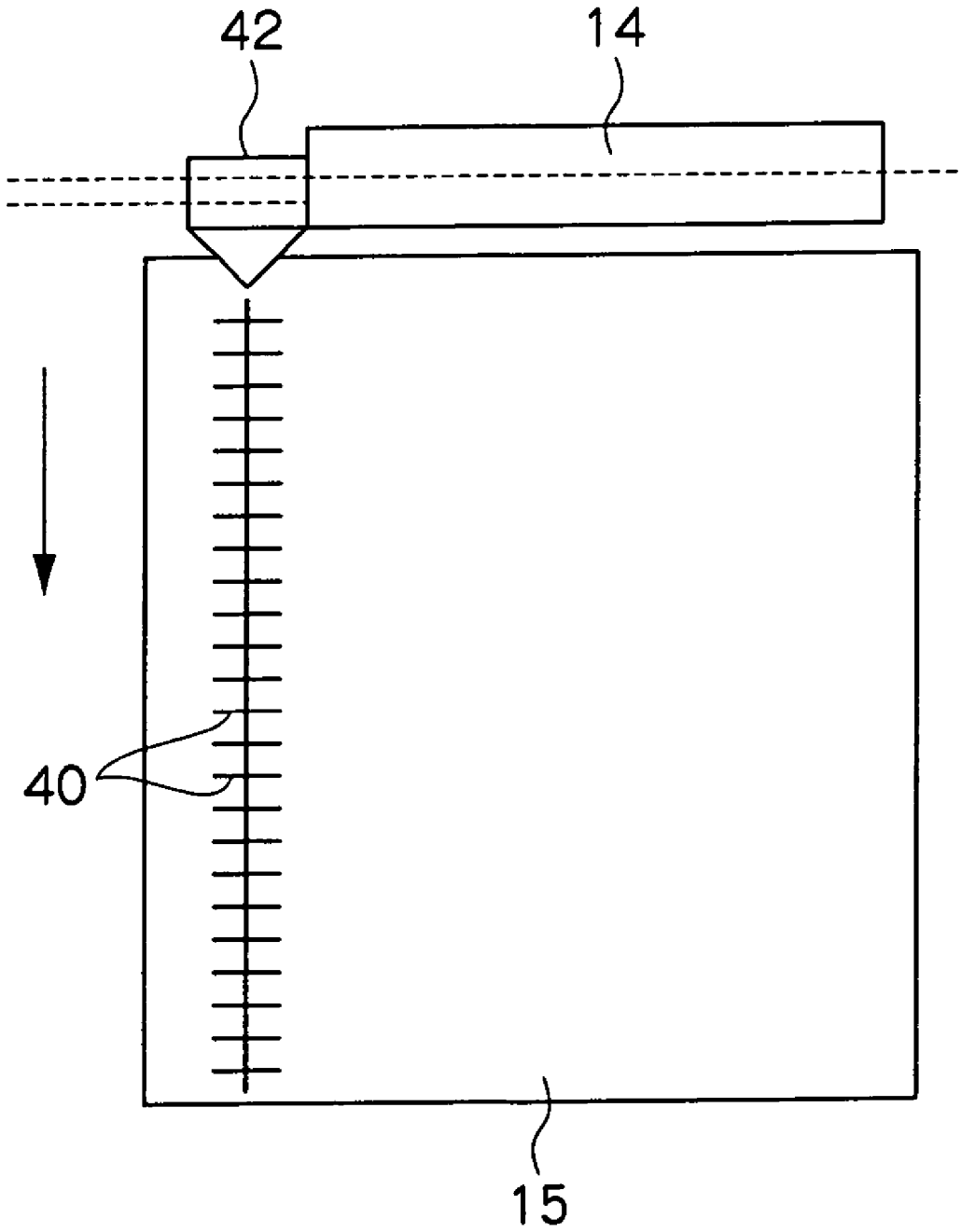
FIG. 19 is a diagram in which the surface of the photosensitive drum of FIG. 18 is expanded along the circumferential direction.

FIGS. 18 and 19 show an example of correcting, in real time, fluctuations in the surface speed which arise due to eccentricity of the photosensitive drum 15. Fluctuations in the surface speed due to eccentricity are the same fluctuations at the same positions of the photosensitive drum 15. Therefore, at the circumferential direction reading sensor 42 and the exposure array 14, the positions with respect to the circumferential direction of the photosensitive drum 15 are made to be offset, and the fluctuations in speed immediately before exposure are detected by the circumferential direction reading sensor 42. On the basis of these results of detection, the exposure timing for exposing the photosensitive drum 15 is corrected.

Namely, a first aspect of the present invention is an image forming apparatus comprising: an image carrier carrying a toner image; an exposure array disposed along an axial direction of the image carrier and forming a latent image; a first reading sensor provided integrally with the exposure array, and reading a first pattern which is provided at uniform intervals along a peripheral direction and which is formed parallel to the axial direction at an outer side of a region of the image carrier where the latent image is formed; and a speed fluctuation detecting unit detecting surface speed fluctuations of the image carrier, on the basis of pattern information read at the first reading sensor.

In the first aspect, the exposure array, which is disposed along the axial direction of the image carrier and forms a latent image, and the first reading sensor, which reads the first pattern which is provided at uniform intervals along the peripheral direction of the image carrier, are provided integrally. Fluctuations in the surface speed of the image carrier can be detected by the speed fluctuation detecting unit from the pattern information read by the first reading sensor.

By providing the exposure array and the first reading sensor integrally, the exposure array and the first reading sensor can be positioned as a fixed positional relationship. Therefore, the positional relationship between the exposure array and the first reading sensor does not change due to, for example, positional fluctuations of the exposure array caused due to errors in the mounting of the exposure array or temperature fluctuations within the image forming apparatus, or the like.

Accordingly, the surface speed of the image carrier at the exposure position along the peripheral direction of the image carrier can be detected accurately. The accuracy of detection is improved, and accordingly, the accuracy of correcting periodic fluctuations (so-called AC fluctuations) in the peripheral direction of the image carrier is improved.

Further, with regard to the distance between the exposure array and the image carrier, highly-accurate mounting is required from the standpoint of limits on the focal depth (±0.1 mm). Therefore, by providing the first reading sensor integrally with the exposure array, the mounting accuracy of the first reading sensor with respect to the image carrier also improves. Thus, the adjusting of the focal depth of the first reading sensor, which has an enlarging/reducing optical system, can be carried out with high accuracy, and the accuracy of detection can be improved.

The image forming apparatus of the first aspect of the present invention may be provided with a first correcting unit correcting a writing timing of the exposure array, on the basis of the speed fluctuations detected at the speed fluctuation detecting unit.

In accordance with this structure, the writing timing of the exposure array is corrected by the first correcting unit on the basis of the results of detection of the speed fluctuation detecting unit. In this way, it is possible to correct periodic fluctuations (AC fluctuations), in the image carrier peripheral direction, of the image which are caused by surface speed fluctuations which are detected by the speed fluctuation detecting unit.

The image forming apparatus of the first aspect of the present invention may be provided with a second correcting unit which, on the basis of the speed fluctuations detected at the speed fluctuation detecting unit, corrects an angular velocity at which the image carrier is driven.

In accordance with this structure, on the basis of the results of detection of the speed fluctuation detecting unit, the second correcting unit computes the angular velocity of the image carrier, and corrects the angular velocity of the image carrier. In this way, it is possible to correct periodic fluctuations (AC fluctuations), in the image carrier peripheral direction, of the image which are caused by surface speed fluctuations which are detected by the speed fluctuation detecting unit.

At the above-described correcting unit, on the basis of the speed fluctuations detected at the speed fluctuation detecting unit, a correction signal, whose phase is different than the speed fluctuations, may be generated, and correction may be carried out on the basis of the correction signal.

In accordance with this structure, a correction signal, whose phase is different than that of the surface speed fluctuations of the image carrier, is generated on the basis of results of detection of the speed fluctuation detecting unit. By correcting the speed fluctuations on the basis of this correction signal, the surface speed fluctuations of image carrier are made to be small.

A second aspect of the present invention is an image forming apparatus comprising: an image carrier carrying a toner image; an exposure array disposed along an axial direction of the image carrier and forming a latent image; a second reading sensor provided integrally with the exposure array, and reading a second pattern which is provided along a peripheral direction and which is formed so as to intersect the axial direction at an outer side of a region of the image carrier where the latent image is formed; and a position fluctuation detecting unit which, on the basis of pattern information read at the second reading sensor, detects axial direction positional fluctuations of the image carrier with respect to the exposure array.

In the above-described second aspect, the second pattern is formed at an incline with respect to the axial direction of the image carrier, and is provided at uniform intervals along the peripheral direction. The second reading sensor, which reads the second pattern, is provided. From the pattern information read by the second reading sensor, the position fluctuation detecting unit can detect the axial direction positional offset of the image carrier with respect to the exposure array.

In the same way as in the detection of periodic fluctuations in the peripheral direction of the image carrier, by providing the exposure array and the second reading sensor integrally, the positional relationship between the exposure array and the second reading sensor does not change due to positional fluctuations of the exposure array or the like.

Accordingly, the axial direction fluctuations of the image carrier with respect to the exposure array can be detected accurately. The accuracy of detection is improved, and accordingly, the accuracy of correcting periodic fluctuations (so-called AC fluctuations) in the axial direction of the image carrier is improved.

The image forming apparatus of the second aspect may have a third correcting unit correcting exposure positions of the exposure array in the axial direction of the image carrier, on the basis of the axial direction positional fluctuations detected at the position fluctuation detecting unit.

In accordance with this structure, on the basis of the results of detection of the speed fluctuation detecting unit, the third correcting unit corrects the exposure positions of the exposure array in the axial direction of the image carrier. The axial direction positional offset of the image carrier with respect to the exposure position can thereby be corrected. In this case, the exposure positions may be changed by changing the light-emitting positions of the exposure array, or the position of the exposure array itself may be shifted along the axial direction of the image carrier.

In the above-described correcting unit, on the basis of the positional fluctuations detected at the position fluctuation detecting unit, a correction signal, whose phase is different than the positional fluctuations, may be generated, and correction may be carried out on the basis of the correction signal.

In accordance with this structure, a correction signal, whose phase is different than that of the axial direction positional fluctuations of the image carrier, is generated on the basis of results of detection of the position fluctuation detecting unit. By correcting the positional fluctuations on the basis of this correction signal, the axial direction positional fluctuations of image carrier are made to be small.

A third aspect of the present invention is an image forming apparatus comprising: an image carrier carrying a toner image; an exposure array disposed along an axial direction of the image carrier and forming a latent image; an image sensor provided integrally with the exposure array, and reading a third pattern which is provided at uniform intervals along a peripheral direction at an outer side of a region of the image carrier where the latent image is formed; and a detecting unit which, on the basis of pattern information read at the image sensor, detects axial direction positional fluctuations and surface speed fluctuations of the image carrier with respect to the exposure array.

In the third aspect, the third pattern is provided at uniform intervals along the peripheral direction of the image carrier. The image sensor which reads the third pattern is provided. From the pattern information read by the image sensor, the detecting unit can detect the surface speed fluctuations and the axial direction positional fluctuations of the image carrier with respect to the exposure array.

By providing the exposure array and the image sensor integrally, the positional relationship between the exposure array and the image sensor does not change due to positional fluctuations of the exposure array or the like.

Accordingly, the surface speed and the axial direction fluctuations of the image carrier with respect to the exposure array can be detected accurately. The accuracy of detection is improved, and accordingly, the accuracy of correcting periodic fluctuations (so-called AC fluctuations) in the axial direction and the surface speed of the image carrier is improved.

Because the present invention is structured as described above, in the first aspect of the present invention, by providing the exposure array and the first reading sensor integrally, the exposure array and the first reading sensor can be positioned as a fixed positional relationship. Therefore, the surface speed of the image carrier at the exposure position along the peripheral direction of the image carrier can be detected accurately. The detection accuracy is improved, and accordingly, the accuracy of correcting the periodic fluctuations (so-called AC fluctuations) in the peripheral direction of the image carrier is improved.

In the second aspect of the present invention, by providing the exposure array and the reading sensor integrally, the positional relationship between the exposure array and the second reading sensor does not change due to positional fluctuations of the exposure array or the like. Therefore, axial direction fluctuations of the image carrier with respect to the exposure array can be detected accurately. The detection accuracy is improved, and accordingly, the accuracy of correcting the periodic fluctuations (so-called AC fluctuations) in the axial direction of the image carrier is improved.

In the third aspect of the present invention, by providing the exposure array and the reading sensor integrally, the positional relationship between the exposure array and the image sensor does not change due to positional fluctuations of the exposure array or the like. Therefore, the surface speed and axial direction fluctuations of the image carrier with respect to the exposure array can be detected accurately. The detection accuracy is improved, and accordingly, the accuracy of correcting the periodic fluctuations (so-called AC fluctuations) in the axial direction and the surface speed of the image carrier is improved.

What is claimed is:

1. An image forming apparatus comprising:

an image carrier that carries a toner image;

an exposure array that forms a latent image, the exposure array being disposed along an axial direction of the image carrier;

a first reading sensor that reads a first pattern, the first pattern being provided at uniform intervals along a peripheral direction and formed substantially parallel to the axial direction at a region, the region being excepted from a region where the latent image is formed, the first reading sensor being provided integrally with the exposure array; and a speed fluctuation detecting unit that detects surface speed fluctuations of the image carrier based on the first pattern read by the first reading sensor.

2. The image forming apparatus according to claim 1, further comprising:

a first correcting unit that corrects writing timing of the exposure array based on the fluctuations detected by the speed fluctuation detecting unit.

3. The image forming apparatus according to claim 2, wherein a correction signal whose phase is different than a phase of the fluctuations is generated and correction is carried out based on the correction signal.

4. The image forming apparatus according to claim 1, further comprising:

a second correcting unit that corrects an angular velocity at which the image carrier is driven based on the fluctuations.

5. The image forming apparatus according to claim 4, wherein a correction signal whose phase is different than a phase of the fluctuations is generated and correction is carried out based on the the correction signal.

6. An image forming apparatus comprising:

an image carrier that carries a toner image;

an exposure array that forms a latent image, the exposure array being disposed along an axial direction of the image carrier;

a second reading sensor that reads a second pattern, the second pattern being provided along a peripheral direction and formed so as to intersect the axial direction at a region, the region being excepted from a region where the latent image is formed, the second reading sensor being provided integrally with the exposure array; and a position fluctuation detecting unit that detects axial direction positional fluctuations of the image carrier with respect to the exposure array based on the second pattern.

7. The image forming apparatus according to claim 6, further comprising:

a third correcting unit that corrects exposure positions of the exposure array in the axial direction of the image carrier based on the fluctuations detected by the position fluctuation detecting unit.

8. The image forming apparatus according to claim 7, wherein a correction signal whose phase is different than a phase of the fluctuations is generated and correction is carried out based on the correction signal.

9. An image forming apparatus comprising:

an image carrier that carries a toner image;

an exposure array that forms a latent image, the exposure array being disposed along an axial direction of the image carrier and;

an image sensor reads a third pattern, the third pattern being provided at uniform intervals along a peripheral direction at a region, the region being excepted from a region where the latent image is formed, the image sensor being provided integrally with the exposure array; and a detecting unit that detects axial direction positional fluctuations and surface speed fluctuations of the image carrier with respect to the exposure array based on the third pattern read by the image sensor.

10. An image forming apparatus comprising:

an image carrier that carries a toner image;

an exposure array that forms a latent image, the exposure array being disposed along an axial direction of the image carrier; a reading sensor that reads a pattern, the reading sensor being provided integrally with the exposure array, the pattern being provided along a peripheral direction at a region, and the region being excepted from a region where the latent image is formed; and a fluctuation detecting unit that detects fluctuations of the image carrier based on the pattern.

11. The image forming apparatus according to claim 10, further comprising;

a correcting unit that corrects exposure based on the fluctuations detected by the fluctuation detecting unit.

12. The image forming apparatus according to claim 11, wherein the correcting unit generates a correction signal whose phase is different than a phase of the fluctuations, and the correcting unit carries out correction based on the correction signal.

13. The image forming apparatus according to claim 10, wherein the pattern has a pattern which is provided at uniform intervals along the peripheral direction and is formed substantially parallel to the axial direction, and the fluctuation detecting unit has a speed fluctuation detecting unit which detects surface speed fluctuations of the image carrier on the basis of the pattern information read by the reading sensor.

14. The image forming apparatus according to claim 13, further comprising:

a correcting unit that corrects writing timing of the exposure array on the basis of the speed fluctuations detected by the speed fluctuation detecting unit.

15. The image forming apparatus according to claim 13, further comprising:

a correcting unit that corrects an angular velocity at which the image carrier is driven based on the speed fluctuations.

16. The image forming apparatus according to claim 10, wherein the pattern has a pattern which is provided along the peripheral direction and is formed so as to intersect the axial direction, and the fluctuation detecting unit has a position fluctuation detecting unit which, on the basis of the pattern information read at the reading sensor, detects axial direction positional fluctuations of the image carrier with respect to the exposure array.

17. The image forming apparatus according to claim 16, further comprising:

a correcting unit that corrects exposure positions of the exposure array in the axial direction of the image carrier, on the basis of the axial direction positional fluctuations detected at the position fluctuation detecting unit.

18. The image forming apparatus according to claim 10, wherein the pattern has a first pattern which is provided at uniform intervals along the peripheral direction and is formed substantially parallel to the axial direction, and a second pattern which is provided along the peripheral direction and is formed so as to intersect the axial direction, the reading sensor has a first reading sensor reading the first pattern, and a second reading sensor reading the second pattern, and the fluctuation detecting unit has a speed fluctuation detecting unit detecting surface speed fluctuations of the image carrier on the basis of pattern information read at the first reading sensor, and a position fluctuation detecting unit detecting axial direction positional fluctuations of the image carrier with respect to the exposure array on the basis of pattern information read at the second reading sensor.

19. The image forming apparatus according to claim 18, further comprising:

a correcting unit that corrects exposure positions of the exposure array in the axial direction of the image carrier, on the basis of the speed fluctuations detected at the speed fluctuation detecting unit and the axial direction positional fluctuations detected at the position fluctuation detecting unit.

20. The image forming apparatus according to claim 10, wherein the reading sensor has an image sensor reading the pattern, and the fluctuation detecting unit has a detecting unit which, on the basis of pattern information read at the image sensor, detects axial direction positional fluctuations and surface speed fluctuations of the image carrier with respect to the exposure array.

21. The image forming apparatus according to claim 10, wherein the image carrier is substantially cylindrical.

22. An image forming apparatus comprising:

an image carrier that carries a toner image;

an exposure array that forms a latent image;

a reading sensor that reads a pattern, the reading sensor being provided integrally with the exposure array; and a detecting unit that detects fluctuation based on the pattern read by the reading sensor.

23. The image forming apparatus according to claim 22, wherein the pattern is provided at uniform intervals along a peripheral direction and formed substantially parallel to an axial direction at a region, the region is excepted from a region where the latent image is formed.

24. The image forming apparatus according to claim 22, wherein the fluctuation has surface speed fluctuation of the image carrier or axial direction positional fluctuation of the image carrier.

* * * * *